United States Patent [19]

Malachowski et al.

[11] Patent Number: 4,573,555

[45] Date of Patent: Mar. 4, 1986

[54] BRAKE RIGGING FOR A RAILWAY VEHICLE TRUCK

[75] Inventors: Jerome A. Malachowski, Hamburg; James F. Horvatis, West Seneca, both of N.Y.

[73] Assignee: Buffalo Brake Beam, Buffalo, N.Y.

[21] Appl. No.: 652,957

[22] Filed: Sep. 20, 1984

[51] Int. Cl.[4] ..... B61H 13/20

[52] U.S. Cl. ..... 188/52; 188/153 R

[58] Field of Search ..... 188/47, 49, 51, 52, 188/53, 153 R

[56] References Cited

U.S. PATENT DOCUMENTS 981,941 1/1911 Porter ..... 188/52

3,780,837 12/1973 Haydu ..... 188/52 X

*Primary Examiner*—Duane A. Reger

*Attorney, Agent, or Firm*—Christel, Bean & Linihan

[57] ABSTRACT

A brake rigging for a railway vehicle truck including two brake beams and a brake cylinder assembly utilizes two lever assemblies so connected between the end portions of the brake beams and the brake cylinder assembly that actuation of the cylinder assembly moves the brake beams away from one another. The cylinder assembly includes a cylinder and a piston slidably disposed within the cylinder, and the lever assemblies are comprised of two primary levers and two secondary levers. The two primary levers are each pivotally connected to a corresponding end portion of one of the brake beams and to a corresponding one of the cylinder or piston of the brake cylinder assembly. The two secondary levers are each pivotally connected to a corresponding end portion of the other of the brake beams and to a corresponding one of the primary levers intermediate the ends of the primary lever. When the brake cylinder is actuated, the primary levers move relative to one another in order to move the two brake beams farther apart.

23 Claims, 5 Drawing Figures

BRAKE RIGGING FOR A RAILWAY VEHICLE TRUCK

BACKGROUND OF THE INVENTION

This invention relates generally to brake rigging for a railway vehicle truck and relates more particularly to a wheel tread brake rigging for a two-axle, four-wheel railway vehicle truck.

The conventional brake rigging with which this invention is concerned includes two brake beams, at least one brake cylinder assembly supported by one or both of the brake beams, and a lever or linkage assembly so connected between the brake beams and cylinder assembly that actuation of the cylinder assembly moves the brake beams away from one another and into braking engagement with treads of wheels of a railway vehicle truck. U.S. Pat. Nos. 2,996,963 and 3,107,754 each describe an example of such a brake rigging. Commonly, however, a conventional brake rigging is relatively heavy and is therefore responsible for a significant fraction of the power required to move its vehicle truck along railway tracks.

It is an object of the present invention to provide a new and improved brake rigging for a two-axle, four-wheel railway vehicle truck which is relatively light in weight.

Another object of the present invention is to provide such a brake rigging for applying effective braking force to the truck wheels through relatively lightweight brake beams.

Still another object of the present invention is to provide such a brake rigging for applying effective braking force to the truck wheels with a relatively small brake cylinder assembly.

Yet still another object of the present invention is to provide a brake rigging having a control system which can be assembled as an integral part of a railway car truck assembly.

A further object of the present invention is to provide a brake rigging having a safety hand brake which is totally contained within the truck assembly.

SUMMARY OF THE INVENTION

This invention relates to a new and improved brake rigging for a four-wheel type of railway vehicle truck having a frame with a longitudinal axis and a transverse axis.

The brake rigging comprises two brake beams, a brake cylinder assembly, two primary levers and two secondary levers. The two brake beams extend transversely of and are movably supported by the truck frame, and the brake cylinder assembly includes a cylinder and a piston being slidably disposed within the cylinder.

The two primary levers each have an effort arm portion and a response arm portion, and the two secondary levers each have two end portions. The response arm portion of each primary lever is pivotally connected to a corresponding end portion of one of the two brake beams, and the effort arm portion of each primary lever is pivotally connected to a corresponding one of the cylinder and the piston of the brake cylinder assembly. One end portion of each secondary lever is pivotally connected to a corresponding end portion of the other of the two brake beams, and the other end portion of each secondary lever is pivotally connected to a corresponding one of the primary levers intermediate the effort and response arm portion thereof so that when the brake cylinder assembly is actuated, the effort arm portions of the primary levers move relative to one another to move the two brake beams farther apart.

It has been found that the brake rigging of this invention, when utilized in a braking application, exposes its brake beams to a relatively small amount of stress. Thus, the brake beams of the rigging of this invention can be relatively small in size and light in weight. Furthermore, it has been found that the brake rigging of this invention, when utilized in a braking application, requires that a relatively small amount of force be exerted by the cylinder assembly in order to transmit effective braking forces to the truck wheels. Thus, the brake cylinder assembly of the rigging of this invention can be relatively small in size and light in weight.

DETAILED DESCRIPTION OF ILLUSTRATIVE EMBODIMENTS

Figure 1:
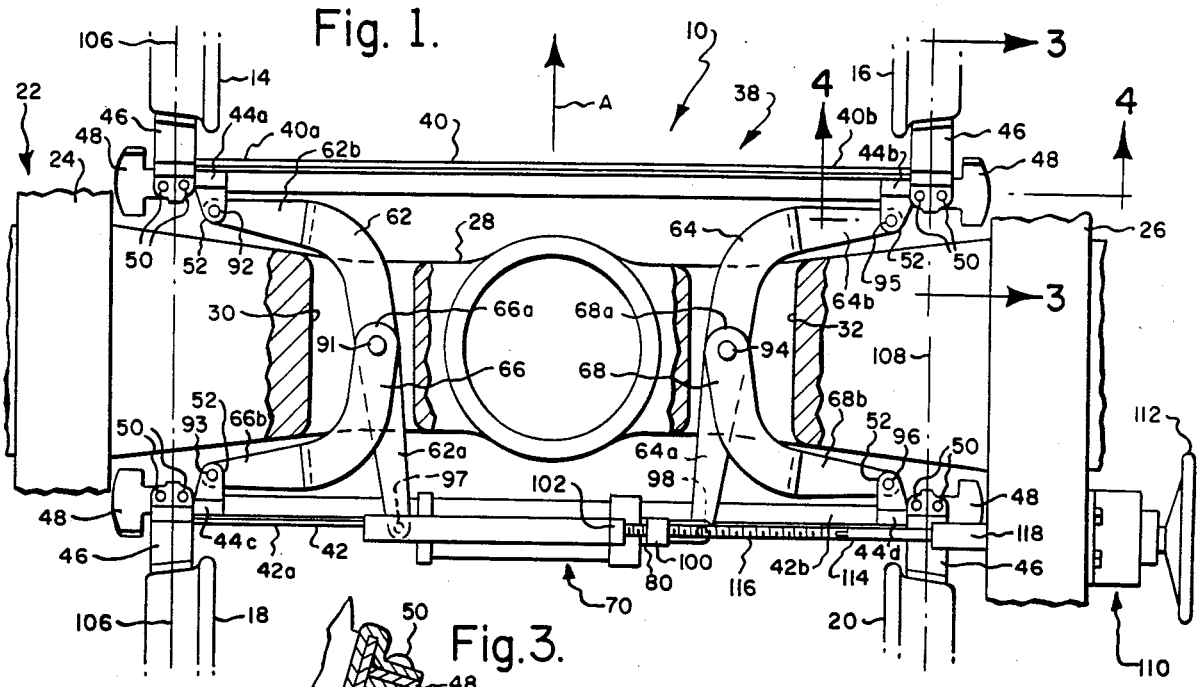
FIG. 1 illustrates in plan view one embodiment of a brake rigging in accordance with the present invention.

Turning now to the drawings in greater detail, there is shown in FIG. 1 a portion of a four-wheel railway vehicle truck, generally indicated 10, in which one embodiment of a brake rigging in accordance with the present invention is utilized. The truck 10 includes four wheels 14,16,18,20 secured at corresponding ends of each of two spaced and parallel axles (not shown) and a frame, generally indicated 22, having frame side members 24,26. The rotational axis of the two truck axles are contained substantially in a plane, and the frame 22 has a longitudinal axis and a transverse axis.

Figure 2:
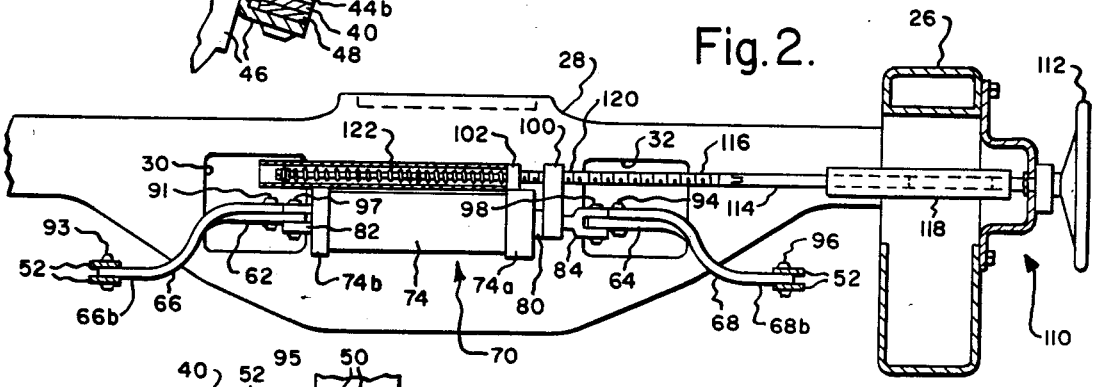
FIG. 2 is a fragmentary elevation view, shown partially in section, of the FIG. 1 brake rigging as seen from below in FIG. 1.

The longitudinal axis of the frame 22 is oriented substantially parallel to the plane containing the two aforesaid rotational axes and parallel to the direction, indicated by the arrow A, in which the truck 10 is permitted to move along railway rails. The transverse axis of the frame 22 is oriented substantially parallel to the plane containing the aforesaid rotational axes and is perpendicular to the direction indicated by the arrow A. Extending between the side frame members 24 and 26 in a manner well-knownin the art is a truck bolster 28. As best shown in FIG. 2, the truck bolster 28 defines two openings or windows 30,32 intermediate its ends and whose purpose will be apparent hereinafter.

Referring to FIGS. 1 and 2, the truck 10 includes a brake rigging 38 for applying braking forces to the truck wheels 14,16,18 and 20. The brake rigging 38 includes two brake beams 40,42 arranged transversely of the truck frame 22 and, as shown in FIG. 1, substantially parallel to one another. Each brake beam 40 or 42 is supported by the side frame members 24 and 26 for sliding movement relative thereto and along the longitudinal axis of the frame 22. More specifically, the beam 40 has a first end portion, indicated **40*a*, which is movably supported by the frame side member 24 and has a second end portion, indicated 40***b*, which is movably supported by the frame side member 26. The beam 42 has a first end portion, indicated 42*a*, which is movably supported by the frame side member 24 and has a second end portion 42*b*, which is movably supported by the frame side member 26. Each brake beam 40 or 42 is constructed of steel or other structural material and is substantially the same size and shape as the other beam 42 or 40. Furthermore and with reference to FIG. 3, each brake beam 40 or 42 is L-shaped in cross-section and is relatively light in weight.

Figure 3:
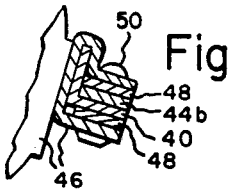
FIG. 3 is a fragmentary cross-sectional view taken about on line 3—3 of FIG. 1.
Figure 4:
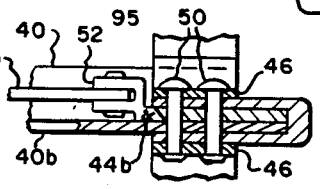
FIG. 4 is a fragmentary cross-sectional view taken about on line 4—4 of FIG. 1.

Supported at each end portion of each of the brake beams 40 or 42 and with reference to FIGS. 1, 3 and 4, is a fulcrum 44*a*, 44*b*, 44*c* or 44*d*, a conventional brake head 46, and a wear plate 48 which are fixedly joined together with rivets 50,50. Each fulcrum 44*a*, 44*b*, 44*c* or 44*d* has a portion which, with its corresponding brake beam end portion 40*a*, 40*b*, 42*a* or 42*b* is sandwiched between flanges of the wear plate 48, and the wear plate flanges are, in turn sandwiched between flanges of the brake head 46. Each of the fulcrum, brake end portion, wear plate flanges and brake head flanges defines aligned apertures through which the shanks of the rivets 50,50 extend so that these components are tightly held together between opposite heads of the rivets 50,50. Each fulcrum 44*a*, 44*b*, 44*c* or 44*d* includes a bifurcated portion 52 which, as best shown in FIG. 4, includes forks which are relatively close to and extend generally away from the brake head 46 to which it is attached. The forks of each extending bifurcated portion 52 define aligned openings having a central axis which is substantially perpendicular to the longitudinal and transverse axes of the truck frame 22.

During a braking operation of the rigging 38, the brake beams 40 and 42 move in a manner similar to that of conventional beams in order to brake the truck 10. More specifically, during a braking application, the brake beams 40 and 42 move away from one another to force the brake shoes 46,46 into braking engagement with the treads of the truck wheels. It will be understood that as the brake beams 40 and 42 are forced apart by means hereinafter described, each brake beam end portion transmits a braking force to its corresponding wheel. Such a transmitted braking force is believed to include a force component which is directed through the region of a corresponding brake beam end portion to which a corresponding brake head 46 is connected and along a path which is oriented generally longitudinally of the truck frame 22. It is further believed that, with regard to the brake rigging 38, such a transmitted force component is centered about the longitudinal midplane of its corresponding brake head. With reference to FIG. 1, the longitudinal midplanes of the brake heads 46,46 to one side of the truck frame 22 are contained in the plane indicated 106, and the longitudinal midplanes of the brake heads 46, 46 to the other side of the frame 22 are contained in the plane indicated 108.

Each fulcrum 44*a* or 44*c* is so positioned in relation to the plane 106 that the central axis of the aligned openings of its bifurcated portion 52 is relatively close to the plane 106, and each fulcrum 44*b* or 44*d* is so positioned in relation to the plane 108 that the central axis of the aligned openings of its bifurcated portion 52 is relatively close to the plane 108. It has been found that a spacing within the range of about 2 to 8 inches (5 to 20 cm) between each of these central axes and its corresponding plane 106 or 108 is suitable.

The brake rigging 38 further includes two primary levers 62,64, two secondary levers 66,68 and brake cylinder assembly 70. The levers 62,64,66,68 are so connected to one another and between the brake beams 42,44 and the brake cylinder assembly 70 that actuation of the cylinder assembly 70 moves brake beams 40,42 further apart and thereby moves the brake heads 46,46 into engagement with treads of the truck wheels 14,16,18,20.

Referring to FIGS. 1 and 2, the brake cylinder assembly 70 is oriented substantially parallel to the transverse axis of the truck frame 22 and includes a cylinder casing 74 and a piston (not shown). A cylinder is defined within the casing 74, and the piston is slidably disposed within the cylinder. A piston rod 80 is connected to the piston for movement therewith and includes a clevis 84 at the end of the rod 80 opposite the piston. Fixedly attached, or keyed, to the piston rod 80 adjacent the clevis is a block member 100 whose purpose will be set forth hereinafter.

The cylinder casing 74 includes two end caps 74*a* and 74*b* fixedly positioned at opposite ends of the cylinder assembly. One end cap 74*a* includes a flange portion 102 which extends upwardly as viewed in FIG. 2. The other end cap 74*b* includes a clevis 82 as shown in FIG. 2. Each clevis 82 or 84 of the cylinder assembly 70 is bifurcated so as to include two forks which extend generally parallel to the longitudinal axis of the assembly. The forks of each clevis 82 or 80 define aligned openings for a reason which will be hereinafter apparent, each of such aligned openings having a central axis which is substantially perpendicular to both the longitudinal and transverse axes of the truck frame 22.

The primary levers 62,64 of the brake rigging 38 each extend through a corresponding window 30 or 32 defined in the truck bolster 28 and are connected between the brake beam 40 and the brake cylinder assembly 70. More specifically, the primary lever 62 includes an effort arm portion 62*a* which is pivotally joined to the clevis 82 of the cylinder casing 74 and includes a response arm portion 62*b* which is pivotally joined to the fulcrum 44*a*. Similarly, the primary lever 64 includes an effort arm portion 64*a* which is pivotally joined to the clevis 84 of the piston rod 80 and includes a response arm portion 64*b* which is pivotally joined to the fulcrum 44*b*. As shown in the plan view of FIG. 1, each effort arm portion 62*a* or 64*a* is relatively straight in shape and each response arm portion 62*b* or 64*b* is arcuate in shape. To accomodate the difference in elevation between the clevises 82 and 80 of the brake cylinder 70 and the fulcrum bifurcated portions 52,52 as shown in FIG. 2, the response arm portions 62*b* and 64*b* are somewhat S-shaped as viewed from the side.

Each effort arm portion 62*a* or 64*a* and response arm portion 62*b* or 64*b* is positioned between the bifurcation forks of its corresponding clevis or fulcrum and defines an opening which aligns with the aligned openings therein. Through these aligned openings extends a pivot pin 92,95,97 or 98 for effecting the aforedescribed pivotal joinder between the primary levers 62,64 and the brake beam 40 and between the primary levers 62, 64 and the cylinder assembly 70. Along the length of each primary lever 62 or 64 and intermediate its effort arm portion and its response arm portion is defined a through-bore having a central axis which is substantially perpendicular to both the longitudinal and transverse axes of the truck frame 22. Tightly received by the through-bore of each primary lever is a pivot bushing.

The secondary levers 66,68 are connected between the brake beam 42 and the primary levers 62,64. More specifically, the secondary lever 66 includes an end portion 66*a* which is pivotally joined to the primary lever 62 intermediate its effort arm portion 62*a* and response arm portion 62*b* and includes an end portion 66*b* which is pivotally joined to the fulcrum 44*c*. Similarly, the secondary lever 68 includes an end portion 68*a* which is pivotally joined to the primary lever 64 intermediate its effort arm portion 64*a* and response arm portion 64*b* and includes an end portion 68*b* which is pivotally joined to the fulcrum 44*d*. As shown in the plan view of FIG. 1, each secondary lever 66 or 68 is arcuate in shape, and as viewed in the elevation view of FIG. 2, each is somewhat S-shaped.

Each end portion 66*a* or 68*a* of the secondary levers 66,68 defines a through-bore, which aligns with the pivot bushing positioned in its corresponding primary lever 62 or 64, and a pivot pin 91 or 94 extends therethrough for effecting the aforedescribed pivotal joinder between the secondary levers 66,68 and the primary levers 62,64. Each end portion 66*b* or 68*b* of the secondary levers 66,68 is positioned between the bifurcation forks of its corresponding fulcrum and defines an opening which aligns with the aligned opening therein. Through these aligned openings extends a pivot pin 93 or 96 for effecting the aforedescribed pivotal joinder between the secondary levers 66,68 and the brake beam 42.

It will be understood from the above that the primary lever 62 and the secondary lever 66 are permitted to move relative to one another about a first pivotal axis extending axially along the pivot pin 91, the primary lever 62 and the brake beam 40 are permitted to move relative to one another about a second pivotal axis extending axially along the pivot pin 92, the secondary lever 66 and the brake beam 42 are permitted to move relative to one another about a third pivotal axis extending axially along the pivot pin 93, the primary lever 64 and secondary lever 68 are permitted to move relative to one another about a fourth pivotal axis extending axially along the pivot pin 94, the primary lever 64 and the brake beam 40 are permitted to move relative to one another about a fifth pivotal axis extending axially along the pivot pin 95, and the secondary lever 68 and the brake beam 42 are permitted to move relative to one another about a sixth pivotal axis extending axially along the pivot pin 96. Furthermore, the primary lever 62 is movable relative to the brake cylinder assembly 70 about a seventh pivotal axis extending axially along the pivot pin 97, and the primary lever 64 is movable relative to the cylinder assembly 70 about an eighth pivotal axis extending axially along the pivot pin 98.

When the brake cylinder assembly 70 is actuated, the piston and cylinder thereof force the effort arm portions 62*a* and 64*a* of the primary levers 62 and 64 to move relative to one another and to pivot about a corresponding one of the pivot pins 92 and 95. As the primary lever 62 is forced to pivot as aforesaid, a force is applied through the primary lever 62 and secondary lever 66 and to the brake beam end portions 40*a* and 42*a* so as to move the brake beam end portions 40*a* and 42*a* away from one another, and as the primary lever 64 is forced to pivot as aforesaid, a force is applied through the primary lever 64 and secondary lever 68 and to the brake beam end portions 40*b* and 42*b* so as to move the brake beam end portions 40*b* and 42*b* away from one another. It follows, then, that as the primary levers 62 and 64 are forced to pivot simultaneously as aforesaid, the brake beams 40 and 42 are forced to move away from one another. Of course, as the brake beams 40 and 42 are moved away from one another, the brake heads 46,46 are guided into braking engagement with the treads of the truck wheels.

When the primary levers 62,64 and secondary levers 66,68 are moved during a braking operation, each brake beam end portion 40*a*, 40*b*, 42*a* or 42*b* receives a force applied to it from the lever to which it is pivotally connected. Such a received force is believed to include a force component which is directed through the region of a corresponding brake beam end portion in close proximity to the site of pivotal joinder between the brake beam end portion and the corresponding lever to which it is connected and along a path which is oriented generally longitudinally of the truck frame 22. It is further believed that, with regard to the brake rigging 38, such a received force component is directed through the axis of the aforesaid site of pivotal joinder. In accordance with this invention, the aforedescribed region of each brake beam end portion for receiving a force from the corresponding lever to which it is connected is relatively close to its aforedescribed corresponding, or adjacent, region of the brake beam end portion for transmitting a braking force to a corresponding truck wheel.

Each primary lever 62 or 64 of the brake rigging 36 is so sized, shaped and so connected to its corresponding secondary lever 66 or 68 that its lever ratio effectively increases during a braking operation. During actuation of the brake rigging 38, the lever ratio of the primary levers increase within the range of about 0.75 (at lower end of range) to 1.5 (at upper end of range) to one.

The aforesaid lever arrangement of the brake rigging 38 is advantageous in that effective braking forces are applied to the truck wheels with a relatively small amount of force being exerted by the brake cylinder assembly 70. For this reason, the brake cylinder assembly is relatively small in size.

Another advantage of the brake rigging 38 relates to the application of forces from the primary and secondary levers to the relative closeness between the region of each brake beam end portion 40*a*, 40*b*, 42*a* or 42*b* at which a lever force is received and the corresponding or adjacent region at which a braking force is transmitted to a truck wheel. Because of such closeness between regions, the brake beams 40,42 are exposed to a relatively small amount of stress during a braking operation. Thus, the brake beams 40,42 can be relatively small in size and, more particularly, slender in shape. It follows that since the brake cylinder assembly 70 and the brake beams 40,42 are relatively small in size, they are also light in weight and the brake rigging 38 is therefore relatively light in weight.

Because several components of the brake rigging 38 are small, the brake rigging 38 is relatively small. Such smallness, or compactness, of the rigging 38 is advantageous in that the remainder of the braking system, namely, the cylinder control valve and the reservoir can be connected to the truck 10 so as to be an integral part thereof.

Associated with the brake rigging 38 and with reference to FIGS. 1 and 2 is a safety hand brake, generally indicated 110. The brake 110 includes a handwheel 112, a rod 114, and a threaded rod 116 and utilizes the block member 100 and the cap flange portion 102, introduced above, of the cylinder casing 74. The block member 100 defines a threaded through-bore through which the threaded rod 116 is threadably received, and the cap flange portion 102 defines a bore aligned with the bore of the block member 100 for receiving the threaded rod 116. The threaded rod 116 is keyed to the flange portion 102 so that rotation of the threaded rod 116 moves the block member 100 and flange portion 102 toward and away from one another and thereby moves the cylinder clevis 82 and the piston rod clevis 84 toward and away from one another. Of course, as the clevis 82 and clevis 84 are moved away from one another, the brake heads 46,46 are moved into braking engagement with the treads of the truck wheels.

The rod 114 is coupled end-to-end with the threaded rod 116, and the handwheel 112 is coupled, by means of a connector 118, to the rod 114. The handwheel 112 is journaled in the truck side frame member 26 so that rotation of the handwheel 112 rotates the threaded rod 116 accordingly. Inasmuch as the safety hand brake of a conventional railway vehicle truck commonly includes a hand brake crank which is attached to the railway car supported by the truck, the aforedescribed hand brake 110 provides an advantage over those of the prior art in that the hand brake 110 is totally contained within the truck 10.

Figure 5:
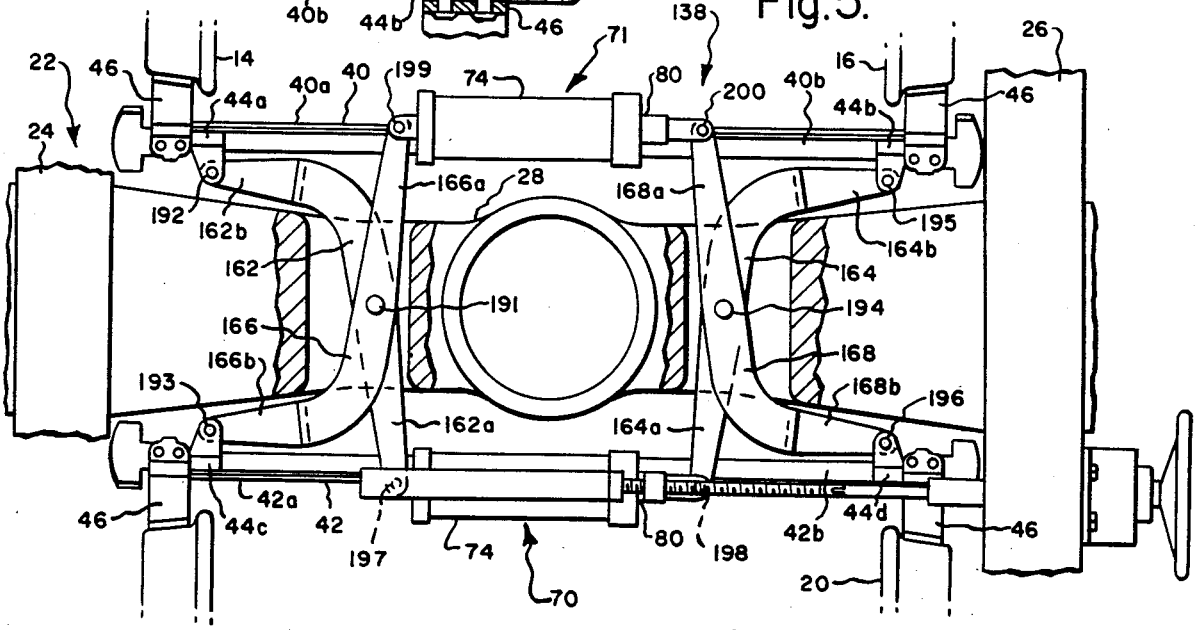
FIG. 5 illustrates in plan view another embodiment of the brake rigging.

FIG. 5 shows an alternative embodiment of a brake rigging, generally indicated 138, in accordance with the present invention. Components corresponding to those previously described in connection with the embodiment of FIGS. 1–4 operate in the same basic fashion as described above and bear the same reference numerals. The brake rigging 138 includes two brake beams 40,42, four levers 162,164,166,168, and two identical brake cylinder assemblies 70,71. The levers 162 and 166 comprise a first pair of levers. As will be set forth in detail hereinafter, the levers 162,164,166,168 are so connected between the brake beams 40 and 42 and between the brake cylinder assemblies 70 and 71 that actuation of the brake cylinder assemblies 70 and 71 move each pair of levers in pincerlike fashion and thereby move the brake beams 40 and 42 away from one another.

The levers 162 and 166 of the first lever pair each defines an effort arm portion 162*a* or 166*a*, respectively, and a response arm portion 162*b* or 166*b*, respectively. The lever effort arm portion 162*a* is pivotally joined, by means of the pivot pin 197, to the cylinder casing 74 of the brake cylinder assembly 70, and the lever response arm portion 162*b* is pivotally joined, by means of the fulcrum 44*a* and pivot pin 192, to the brake beam end portion 40*a*. The lever effort arm portion 166*a* is pivotally joined, by means of the pivot pin 199, to the cylinder casing 74 of the brake cylinder assembly 71, and the lever response arm portion 166*b* is pivotally joined, by means of the fulcrum 44*c* and pivot pin 193 to the brake beam end portion 42*a*. Each lever 162 or 166 is pivotally joined, by means of the pivot pin 191, to the other lever 164 or 162 intermediate its response and effort arm portions at a location substantially centered between the brake beams 40 and 42.

The levers 164 and 168 of the second lever pair each define an effort arm portion 164*a* or 168*a*, respectively, and a response arm portion 164*b* or 166*b*, respectively. The lever effort arm portion 164*a* is pivotally joined, by means of the pivot pin 198, to the piston rod 80 of the brake cylinder assembly 70, and the lever response arm portion 164*b* is pivotally joined, by means of the fulcrum 44*b* and pivot pin 195, to the brake beam end portion 40*b*. The lever effort arm portion 168*a* is pivotally joined, by means of the pivot pin 200, to the piston rod 80 of the brake cylinder assembly 71, and the lever response arm portion 168*b* is pivotally joined, by means of the fulcrum 44*d* and pivot pin 196, to the brake beam end portion 42*b*. Each lever 164 or 168 is pivotally joined by means of the pivot pin 194, to the other lever 168 or 164 intermediate its response and effort arm postions at a location substantially centered between the brake beams 40 and 42.

It will be understood from the above that pivotal movement of one lever relative to the other lever in its corresponding pair moves the lever pair in a pincerlike fashion so as to move the brake beam end portions to which the lever pair is pivotally connected toward and away from one another. It follows from the lever arrangement described above and shown in FIG. 5 that actuation of the brake cylinder assemblies 70 and 71 moves one lever in each pair relative to the other lever in its corresponding pair so that two brake beams move away from one another. Because the brake rigging 138 of FIG. 5 includes two brake cylinder assemblies and the brake rigging 38 of FIGS. 1–4 include only one cylinder assembly, brake rigging 138 may be preferred over brake rigging 38 in an application in which a relatively large amount of cylinder power is desired.

While the present invention has been described in two illustrative embodiments, it will be understood that still further modifications and substitutions can be had without departing from the spirit of the invention. For example, although the brake cylinder assemblies of the embodiments of FIGS. 1–5 have been shown and described as being pivotally connected to the effort arms of two lever assemblies for actuation therebetween, a brake cylinder assembly can be connected to other parts of the two lever assemblies in accordance with the broader aspects of the invention. For example, the brake cylinder assembly can be connected to the two lever assembly regions at which one lever joins its corresponding lever so that when the cylinder assembly is actuated, the levers move in such a manner that the two brake beams move away from one another. In such an arrangement, the piston of the piston cylinder assembly is connected to the region of joinder of the two levers positioned to one side of the vehicle truck and the cylinder of the cylinder assembly is connected to the region of joinder of the two levers positioned to the other side of the vehicle truck.

Furthermore, although each brake cylinder assembly of the embodiments of FIGS. 1–5 has been shown and described as being positioned outside of the space between the two brake beams, a brake cylinder assembly can be so connected between the two lever assemblies as to be positioned between the two brake beams in accordance with this invention. Accordingly, the present invention has been described in the illustrative embodiments by way of illustration rather than limitation.

We claim:

1. A brake rigging for a four-wheel type of railway vehicle truck having a frame with a longitudinal axis and a transverse axis, said rigging comprising:

two brake beams extending transversely of and movably supported by the truck frame, each of said brake beams defining two opposite end portions;

a brake cylinder assembly including a cylinder and a piston, said piston being slidably disposed in said cylinder;

two primary levers each having an effort arm portion and a response arm portion, the response arm portion of each primary lever being pivotally connected to a corresponding end portion of one of said two brake beams, the effort arm portion of each primary lever being pivotally connected to a corresponding one of said cylinder and said piston of said brake cylinder assembly; and two secondary levers each having two end portions, one end portion of each secondary lever being pivotally connected to a corresponding end portion of the other of said two brake beams, the other end portion of each secondary lever being pivotally connected to a corresponding one of the primary levers intermediate the effort and response arm portions thereof so that when said brake cylinder assembly is actuated, said effort arm portions of said primary levers move relative to one another to move said two brake beams away from one another.

2. A brake rigging as defined in claim 1 wherein each brake beam end portion has a first region adapted to receive a first force applied from the corresponding one of the primary and secondary levers to which the brake beam end portion is pivotally connected and has a second region adapted to transmit a second force to a corresponding truck wheel, and said first region and said second region of each of said brake beam end portions are relatively close to one another.

3. A brake rigging as defined in claim 1 wherein each brake beam end portion defines a first location and a second location, said first location is adapted to receive a first force applied from a corresponding one of the primary and secondary levers to which the brake beam end portion is pivotally connected, said second location is adapted to transmit a second force to a corresponding truck wheel, and said first location and said second location of each of said brake beam end portions are relatively close together.

4. A brake rigging as defined in claim 3 wherein said first force includes one force component directed along one path through its corresponding end portion and which is oriented generally longitudinally of the truck frame, said second force includes another force component directed along another path through its corresponding end portion and which is oriented generally longitudinally of the truck frame, and said one path and said another path through each of said brake beam end portions are relatively close together.

5. A brake rigging as defined in claim 3 wherein said first location and said second location of each brake beam end portion are within the range of about two inches (5 cm) to eight inches (20 cm) apart.

6. A brake rigging as defined in claim 1 wherein the lever ratio of each of said primary levers effectively increases as said brake cylinder is actuated.

7. A brake rigging as defined in claim 6 wherein the lever ratio of each of said primary levers increases within the range of about 0.75 to 1.5 to one.

8. A brake rigging as defined in claim 1 wherein said brake cylinder assembly is so arranged in relation to the truck frame that when actuated, said brake cylinder assembly acts along a path which is generally transverse to the truck frame.

9. A brake rigging as defined in claim 1 wherein the axis of pivotal connection between each of the secondary levers and its corresponding primary lever is substantially centered between said two brake beams.

10. A brake rigging as defined in claim 1 further comprising a safety hand brake connected between said brake cylinder assembly and the truck frame so as to be totally contained within the railway vehicle truck.

11. A brake rigging for a four-wheel type of railway vehicle truck having a frame with a longitudinal axis and a transverse axis, said rigging comprising:

two brake beams extending transversally of and movably supported by the truck frame, each of said brake beams defining a first end portion to one side of the frame and a second end portion to the other side of the frame;

a first lever assembly including a first lever and a second lever, said first lever having a response arm portion and an effort arm portion and said second lever having a first end portion and a second end portion, the first end portion of said second lever being pivotally connected to said first lever intermediate the response arm portion and the effort arm portion thereof for pivotal movement of the first and second levers relative to one another about a first pivotal axis, the response arm portion of said first lever being pivotally connected to the first end portion of one brake beam for pivotal movement relative thereto about a second pivotal axis, the second end portion of said second lever being pivotally connected to the first end portion of the other brake beam for pivotal movement relative thereto about a third pivotal axis so that when said first lever is pivotally moved relative to said one brake beam about said second pivotal axis, the first end portions of said brake beams are moved toward and away from one another;

a second lever assembly including one lever and another lever, said one lever having a response arm portion and an effort arm portion and said another lever having a first end portion and a second end portion, the first end portion of said another lever being pivotally connected to said one lever intermediate the response arm portion and the effort arm portion thereof for pivotal movement of said one and another levers relative to one another about a fourth pivotal axis, the response arm portion of said one lever being pivotally connected to the second end portion of a first of the brake beams for pivotal movement relative thereto about a fifth pivotal axis, the second end portion of said another lever being pivotally connected to the second end portion of the second of the brake beams for pivotal movement relative thereto about a sixth pivotal axis so that when said one lever is pivotally moved relative to said first brake beam about said fifth pivotal axis, the second end portions of the brake beams are moved toward and away from one another; and a brake cylinder assembly connected between the effort arm portions of said first lever and said one lever for moving the effort arm portions relative to one another and to thereby move each of said first lever and one of said one lever about a corresponding one of said second and said fifth pivotal axes so that said two brake beams move away from one another.

12. A brake rigging as defined in claim 11 wherein said one brake beam is said first brake beam and said other brake beam is said second brake beam.

13. A brake rigging as defined in claim 12 wherein each brake beam end portion defines a first location and a second location, said first location is adapted to receive a first force applied from a corresponding one of the primary and secondary levers to which the brake beam end portion is pivotally connected, said second location is adapted to transmit a second force to a corresponding truck wheel, and said first location and said second location of each of said brake beam end portions are relative close together.

14. A brake rigging as defined in claim 13 wherein said first force includes one force component directed along one path through its corresponding end portion and which is oriented generally longitudinally of the truck frame, said second force including another force component directed along another path through its corresponding end portion and which is oriented generally longitudinally of the truck frame, and said one path and said another path through each of said brake beam end portions are relatively close together.

15. A brake rigging for a four-wheel type of railway vehicle truck having a frame with a longitudinal axis and a transverse axis said rigging comprising:

two brake beams extending transversely of and movably supported by the truck frame;

a first pair of two levers, each lever in said first lever pair having an effort arm portion and a response arm portion and being pivotally joined to the other lever in said first pair intermediate the effort arm portion and the response arm portion of said other lever, one response arm portion of said first pair being pivotally connected to one of said brake beams and the other response arm portion of said first pair being pivotally connected to the other of said brake beams so that pivotal movement of the levers in said first pair relative to one another moves the response arm portions thereof in pincer-like fashion;

a second pair of two levers, each lever in said second lever pair having an effort arm portion and a response arm portion and being pivotally joined to the companion lever in said second pair intermediate the effort arm portion and the response arm portion of said companion lever, one response arm portion of said second pair being pivotally connected to one of said brake beams and the other response arm portion of said second pair being pivotally connected to the other of said brake beams so that pivotal movement of the levers in said second pair relative to one another moves the response arm portions thereof in a pincerlike fashion;

a first brake cylinder assembly being connected between the effort arm portion of one lever of said first pair and the effort arm portion of one lever of said second pair; and a second brake cylinder assembly being connected between the effort arm portion of the other lever of said first pair and the effort arm portion of the other lever of said second pair so that actuation of said first and second brake cylinder assemblies pivotally moves one lever in each lever pair relative to the other lever in its corresponding pair so that said two brake beams move away from one another.

16. A brake rigging as defined in claim 15 wherein each of said brake beams defines a first end portion to one side of the truck frame and second end portion to the other side of the frame, the response arm portions of said first lever pair are each pivotally connected to a corresponding one of said first brake beam end portion and the response arm portions of said second lever pair are each pivotally connected to a corresponding one of said second brake beam end portions.

17. A brake rigging as defined in claim 16 wherein each brake beam end portion has a first region adapted to receive a first force applied from the corresponding response arm portion to which it is pivotally connected and has a second region adapted to transmit a second force to a corresponding truck wheel, and said first region and said second region of each of said brake beam end portion are relatively close to one another.

18. A brake rigging as defined in claim 15, each lever in said first lever pair being pivotally joined to the other lever in said first pair for movement relative thereto about a first pivotal axis, each lever in said second lever pair being pivotally joined to the other lever in said second pair for movement relative thereto about a second pivotal axis, and said first and second pivotal axes are contained in a plane which is generally perpendicular to the longitudinal axis of the truck frame and which is substantially centered between said brake beams.

19. A brake rigging as defined in claim 15 wherein each of said first and second brake cylinder assemblies is so arranged in relation to the truck frame that when actuated each brake cylinder assembly acts along a path which is generally transverse to the truck frame.

20. A brake rigging as defined in claim 15 wherein each of said levers are so sized that its lever ratio effectively increases as said brake cylinder is actuated.

21. A brake rigging as defined in claim 15 wherein the lever ratio of each lever effectively increases within the range of about 0.75 to 1.5 to one.

22. A brake rigging as defined in claim 10 wherein said safety hand brake includes means for manually actuating said cylinder assembly.

23. A brake rigging for a four-wheel type of railway vehicle truck having a frame with a longitudinal axis and a transverse axis, said rigging comprising:

two brake beams extending transversely of and movably supported by the truck frame, each of said brake beams defining a first end portion to one side of the frame and a second end portion to the other side of the frame;

a first lever assembly including a first lever and a second lever connected to one another for pivotal movement of said first and second levers relative to one another about a first pivotal axis, said first lever having a portion being connected to the first end portion of one brake beam for pivotal movement relative thereto about a second pivotal axis, said second lever having a portion being connected to the first end portion of the other brake beam for pivotal movement relative thereto about a third pivotal axis so that when said first and second levers are pivotally moved relative to one another about said first pivotal axis, the first end portions of said brake beams are moved toward and away from one another;

a second lever assembly including one lever and another lever connected to one another for pivotal movement of said first and second levers relative to one another about a fourth pivotal axis, said one lever having a portion being connected to the second end portion of a first of the brake beams for pivotal movement relative thereto about a fifth pivotal axis, said another lever having a portion being connected to the second end portion of the second of the brake beams for pivotal movement relative thereto about a sixth pivotal axis so that when said one and another levers are pivotally moved relative to one another about said fourth pivotal axis, the second end portions of said brake beams are moved toward and away from one another; and a brake cylinder assembly connected between said first and second lever assemblies for pivotally moving each lever relative to the other lever in its corresponding assembly to thereby move said two brake beams away from one another.

* * * * *